United States Patent [19]

Brentham

[11] 4,247,098

[45] Jan. 27, 1981

[54] DUAL CYLINDER HIP EXERCISING DEVICE

[76] Inventor: Jerry D. Brentham, P.O. Box #599, Belton, Tex. 76513

[21] Appl. No.: 968,462

[22] Filed: Dec. 11, 1978

[51] Int. Cl.[3] ..... A63B 21/00

[52] U.S. Cl. ..... 272/130; 272/134; 272/125; 272/143

[58] Field of Search ..... 272/130, 136, 134, 140, 272/141, 143, 144, DIG. 1, DIG. 4, 125; 128/25 R

[56] References Cited

U.S. PATENT DOCUMENTS

| | | | |
|---|---|---|---|
| 1,902,694 | 3/1933 | Edwards . | |
| 3,074,716 | 1/1963 | Mitchel et al. | 272/130 X |
| 3,103,357 | 9/1963 | Berne . | |
| 3,120,954 | 2/1964 | Apostol . | |
| 3,465,592 | 9/1969 | Perrine . | |
| 3,495,824 | 2/1970 | Cuinier | 272/130 |
| 3,822,599 | 7/1974 | Brentham . | |
| 4,098,502 | 7/1978 | Faust | 272/144 |

*Primary Examiner*—Richard C. Pinkham
*Assistant Examiner*—William R. Browne
*Attorney, Agent, or Firm*—Gerald G. Crutsinger; John F. Booth; Harry C. Post, III

[57] ABSTRACT

A device for exercising the hip and upper leg muscles comprising a support frame with a body support member and leg gripping members rotatably secured to each side of the support frame adapted to grip the leg just above the knee. The axis of rotation of the leg gripping members is adapted to be substantially aligned with the axis of rotation of the ball and socket joint between the upper leg and the hip. A cylinder to control the rate of movement of the leg is pivotally secured between the support frame and each of the leg gripping members to control the rate of movement of the leg gripping members and legs.

5 Claims, 6 Drawing Figures

DUAL CYLINDER HIP EXERCISING DEVICE

BACKGROUND

Athletes today place a tremendous strain on their muscles and joints as they participate in athletic events. Some of the most common injuries to athletes particularly runners involve injuries to the muscles in the groin, thigh and hip areas. These are generally due to the improper strengthening of these muscles in these areas.

It is desireable to use a device which will exercise the upper leg in a running motion, thereby exercising and strengthening the muscles in the hip and thigh areas to prevent the above injuries.

The most efficient way to strengthen the muscles in the hip and thigh area is to isolate them from the rest of the body and exercise them at a controlled rate throughout the entire movement of the leg.

It is particularly important to exercise with muscles utilized in the rearward movement of the leg which pushes the body forward since the leg usually meets no resistance when off the ground and moving outwardly in front of the body when in mid air stride. Therefore, the pulling and pushing muscles encountered once the leg meets the ground and pulls the body and pushes the body forward or the muscles which are most important to strengthen.

Patents which disclose exercising devices utilizing sophisticated hydraulic structures and pumps are U.S. Pat. Nos. 3,120,954; 3,465,592; 3,495,824; and 3,822,599. Other devices have employed series of pulleys and change the rope for lifting weights; however, these devices exercise in a single direction and may not be released without dropping the weight since they utilize gravity as a force for exercising the member.

SUMMARY

I have devised a hip exercising device generally comprising a general frame adapted to sit on the floor and support the body. The body support generally comprises a flat member adapted to support the back of the user in a prone position.

Actuating means, such as a pair of leg gripping members, is pivotally secured to the general frame such that the axis of pivotal movement of each leg gripping member is aligned with the axis of movement of the joint between the thigh and the hip. Means to control the rate of movement of the leg gripping members is pivotally secured between the general frame and the leg gripping members and control the rate of movement of the leg.

Upper body restraint means such as hand grips are secured on either side of the body support member. A pin may be utilized to lock one or both of the leg gripping members into a fixed location to isolate either of the legs in exercising or to perform isometric exercises.

The primary object of this device is to isolate the hip and thigh muscles to efficiently strengthen these muscles to prevent injuries to athletes while they are engaged in sporting activities and to allow independent exercising of each leg or simultaneous exercising of the legs.

A further object of the invention is to provide a simple device which is completely controlled by the user to minimize possibility of injury to the user if he becomes exhausted or tired.

A still further object of the invention is to provide a hip exercising device which requires extended output by the muscles of the user to move the leg in each direction and which orients the leg gripping members such that the axis of rotation is aligned with the axis of rotation of the joint between the thigh and the hip to minimize strain on the hip joint.

Other and further objects of the invention will become apparent upon referring to the detailed description following in the drawings annexed hereto.

DESCRIPTION OF THE DRAWINGS

Drawings of a preferred embodiment of the invention are annexed hereto so that the invention may be better and more fully understood, in which.

Numeral references are used to designate like parts throughout the various figures of the drawing.

DESCRIPTION OF A PREFERRED EMBODIMENT

Figure 1:
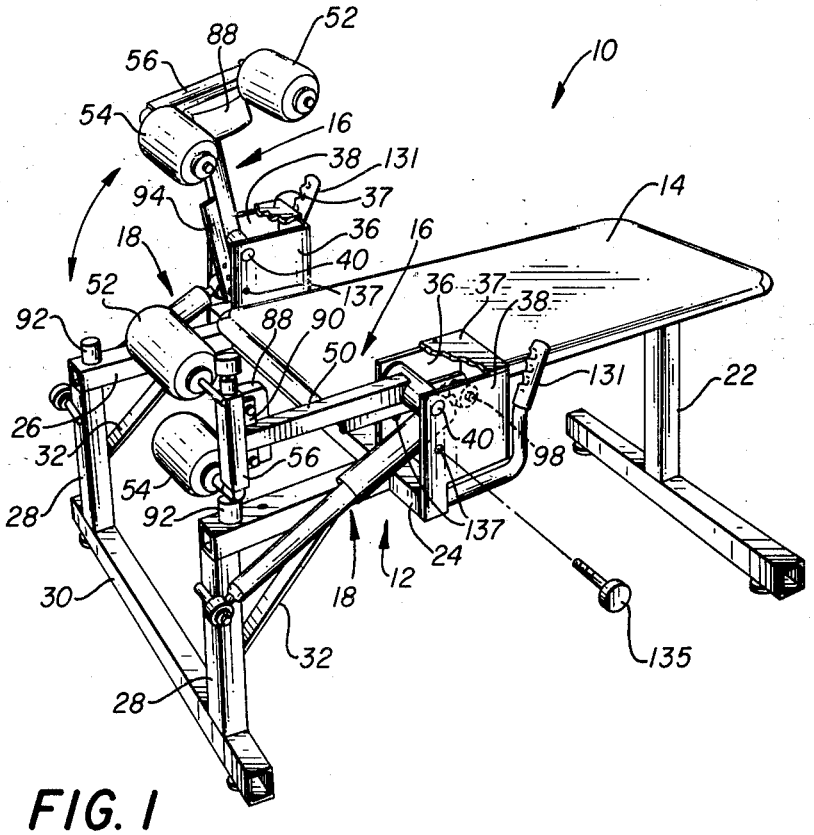
FIG. 1 is a top prespective view of the hip exercising device.

Referring to FIG. 1 of the drawing, the numeral 10 designates the hip exercising device which briefly comprises a support frame 12 and a body support member 14 secured thereto. Actuating means 16 is pivotally secured to either side of the support frame 12 and are operably secured to actuated means 18 which is pivotally secured to the support frame 12.

Figure 2:
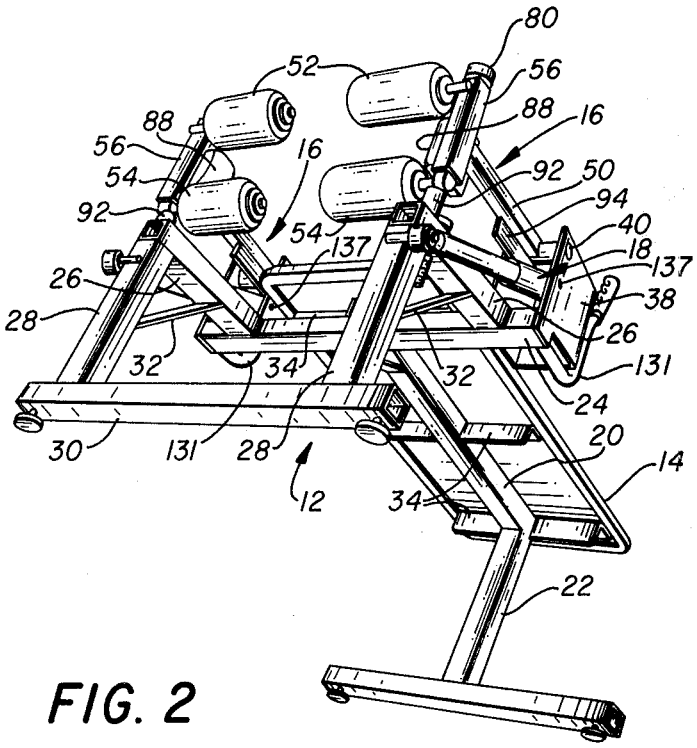
FIG. 2 is a bottom prespective view thereof.
Figure 3:
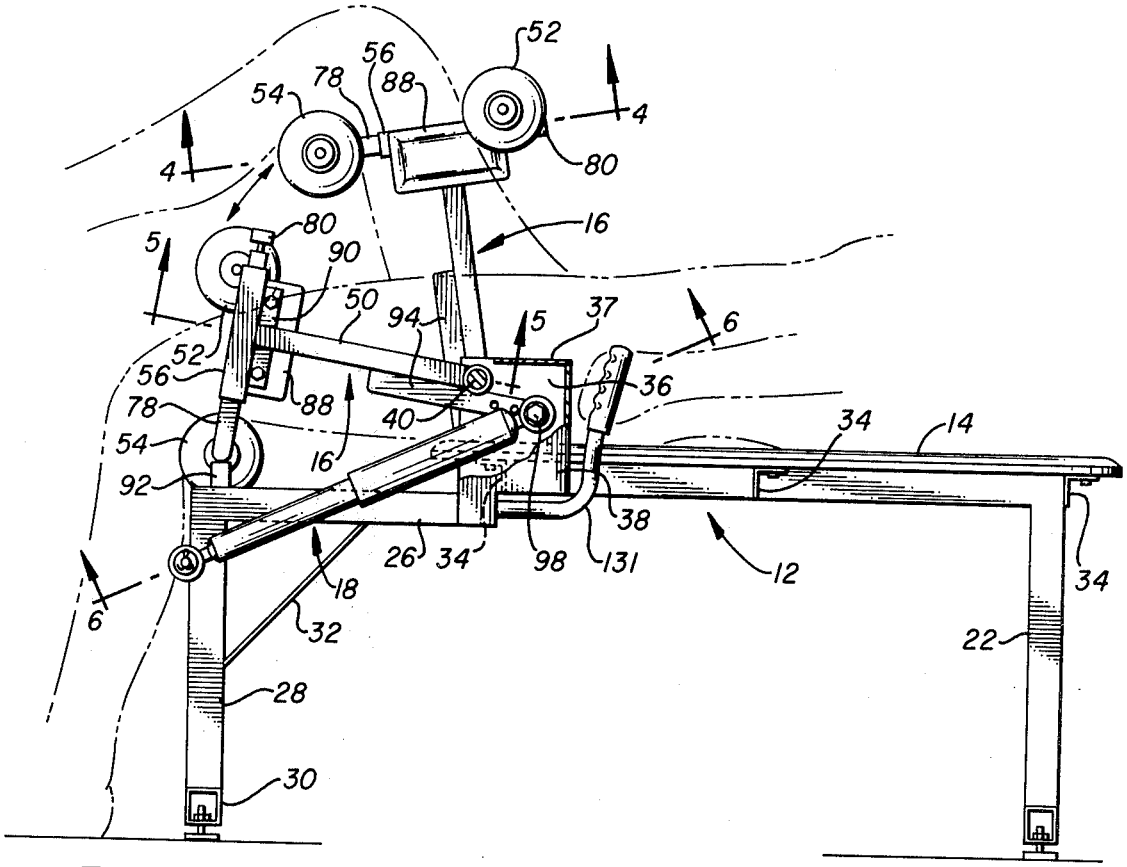
FIG. 3 is an enlarged side elevational view thereof.

As best illustrated in FIGS. 1-3, the support frame generally comprises a central tubular support member 20 supported on a T-shaped leg member 22 at a first end and a U-shaped leg member at the second end. The U-shaped leg comprises a horizontally extending member 24 secured transversely to one end of central support member 20. Side leg members 26 extend longitudinally outward from transverse horizontally extending member 24 and are secured to vertically extending side leg members 28 which are secured to a cross member 30. Angular braces 32 provide additional rigidity to the U-shaped leg to support the second end of the frame 12.

A plurality of transverse angle members 34 provide support for a rectangular shaped padded body support member 14 which is bolted or otherwise secured to the central support frame member 20. The body support member 14 extends over the end of the central support member 20 and terminates adjacent thereto.

Figure 5:
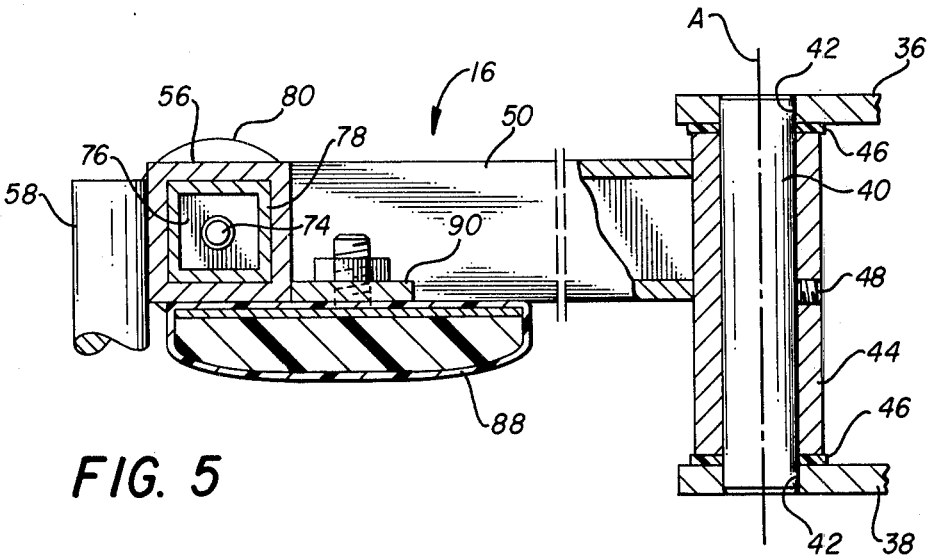
FIG. 5 is a cross-sectional view taken along line 5—5 of FIG. 3.
Figure 6:
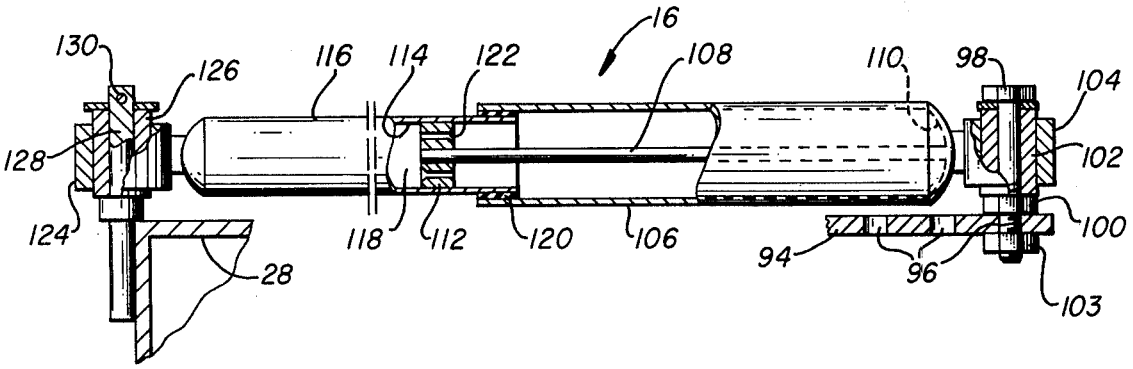
FIG. 6 is a cross-sectional view taken along line 6—6 of FIG. 3 with parts broken away to more clearly illustrate the details of construction.

A pair of actuating means 16 are pivotally secured between a clevis formed by box side members 36 and 38 which are secured in space relation to the ends of horizontally extending support member 24. As best illustrated in FIG. 5, the pivot support generally comprises a shaft 40 journaled through apertures 42 and side members 36 and 38. The central axis A of shaft 40 is adapted to be aligned with the axis of rotation of the ball and hip socket joint between the thigh and the hip of the human user as best illustrated in FIG. 3. A cover 37 is secured over the side members 36 and 38 to protect the user from injury the moving parts.

Figure 4:
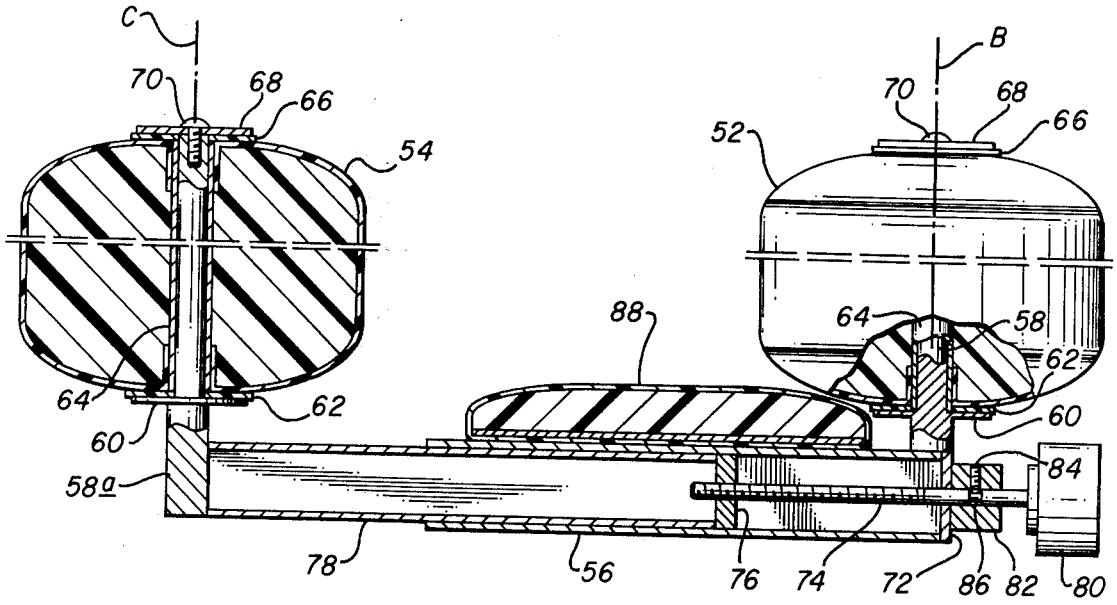
FIG. 4 is a cross-sectional view taken along line 4—4 of FIG. 3 with parts broken away to more clearly illustrate the details of construction.

The actuating means generally comprises a sleeve 44 secured to shaft 40 between wear washer plates 46 and secured thereto by a set screw 48. An outwardly extending arm 50 is rigidly secured to sleeve 44 by welding or the like. A pair of leg gripping means such as rollers 52 and 54 are rotatably secured to the outer end of arm 50. As best illustrated in FIG. 4, means to adjust the distance between the rollers 52 and 54 generally comprises an outer tubular sleeve member 56 rigidly secured to the outer portion of arm 50 by welding or the like.

Roller 52 is rotatably secured to a shaft 58 which is rigidly secured to a first end of sleeve 56. A first shoulder 60 is formed on shaft 58 to support washer 62 to provide a bearing surface for sleeve 64 on one side of roller 52 and a second washer 66 engages the opposite end of sleeve 64 and is held there by washer 68 and screw 70.

An end plate 72 is formed on the outer end of sleeve 56 and has a central opening to receive threaded shaft 74 which is threadedly engaged in an aperture end plate 76 secured to an inner tubular sleeve 78. Inner tubular sleeve 78 is slideably disposed the bore of sleeve 56. A second shaft **58*a* is secured to the outer end of inner tubular sleeve 78. The roller 54 is rotatably secured on shaft 58*a* in a like manner previously described for roller 52. Threaded shaft 74 has a knurled knob 80 to rotate the shaft 74. Shaft 74 is secured to bushing block 82 by set screw 84 in groove 86 to prevent longitudinal movement of the threaded screw 74. Rotation of screw 74 moves end plate 78 longitudinally through the axis of outer sleeve 56. This adjusts the distance between axes B and C of rollers 52 and 54 to compensate for different thigh sizes. Each arm 50 has a set of inwardly facing rollers 52 and 54** which are substantially identical.

A inner pad 88 is secured between the rollers 52 and 54 by angle member 90 secured to the upper end of arm 50 to protect the leg of the user against abrasion. Shaft **58*a* is adapted to engage a stop member 92 on side frame members 26 to limit downwardly motion of the actuating means 16**.

Actuating means 16 is pivotally secured to actuated means 18 by extension member 94 welded to the end of arm 50 adjacent pivot pin 40 and extends outwardly past the axis of rotation A of shaft 40. Extension member 94 has a series of spaced apertures 96 adapted to receive pivot pin 98. Pivot pin 98 is rotatably secured to bushing 102 by nut 100 and to member 94 by lock nut 103.

The actuated means 16 generally comprises a pair of two-way resistant cylinder which are pivotally secured between frame 12 and the actuating means 16 and provides a means for controlling the rate of movement. Means 16 may be a standard motorcycle racing shock comprising an outer cylinder 106 having a piston rod 108 secured to end 110 adjacent bushing member 104. Piston rod 108 is secured to end 110 adjacent bushing member 104. Piston rod 108 is secured to piston 112 which is slideably disposed in the bore 114 of inner sleeve 116 which forms a chamber 118 therein. A seal 120 is provided between the outer sleeve and the inner sleeve 116. Fluid is disposed in chamber 118 and flows through orifices 122 in piston 112 to control the rate of movement of the piston 112 within bore 114 thereby controlling the rate of movement of the actuating means 16. Inner sleeve 116 has a sleeve member 124 secured on bushing 126. Bushing 126 is rotatably secured on shaft 128 welded to the vertical members 28 of the U-shaped leg. A cotter pin 130 maintains the bushing 126 on shaft 128.

Arm restraint means 131 are secured adjacent the position of the arms of the user to aid in restraining upper body movement of the user.

If it is desired that only one leg be used or to utilize the machine for isometrics, a pin 135 is adapted to be aligned through apertures 137 in side members 36 and 38 and one of the apertures 96 an extension member 94 to lock the actuating means 16 is place. This would permit the exercise of one leg which needed to be used more than the other in cases of injury or muscle imbalance.

Operation of the hereinbefore described device is as follows:

The user lies in a prone position with his back on back support member 14 and his legs extending between the rollers 52 and 54 on each of the actuating means 16. The distance between the roller axes B and C is adjusted by turning knob 80 to extend or retract roller 54 relative to roller 52 to grip the leg just above the knee.

While gripping the upper body restraint means 131, which generally comprise a hand grip, the user moves his leg in a running action to independently move the leg outwardly against the force of the actuated means 18 which is being retracted and then moves the leg downwardly extending actuated means 18.

As previously described, one of the actuating means 16 may be locked in position by sliding pin 135 through apertures 137 and aperture 96 in extension member 94. This would allow exercising of a single leg. The body is preferably positioned on body support member 14 such that the axis of rotation of the ball and socket of the hip joint is aligned with the axis of rotation A of shaft 40 and the axis of rotation of arm 50 to prevent undue strain on the ball and socket joint. This allows most efficiently strengthens the thigh and hip muscles utilized in running activity.

The rollers 52 and 54 provide an upper leg gripping means which concentrates the movement of the leg in a vertical plane parallel to the median axis of the body or spine as the user is prone. The actuated means 18 provides a means to control the rate of movement throughout rotation of arm 50 and thereby provides a constant force throughout the movement of arm 50 which is unchanging with the change in the angle of the moment arm of the knee and upper thigh. Further, the actuated means 18 is a non-active or passive device which resists movement and therefore may be stopped at any location without strain on the user should he or she develop a muscle cramp or problem.

It should be readily apparent from the foregoing that the embodiment accomplishes the objects of the invention hereinbefore discussed.

It should be readily apparent that other embodiments of the invention may be devised without departing from the basic concept thereof.

Having described my invention, I claim:

1. A hip and leg exercising device to strengthen the muscles in the hip and legs of a person comprising: a support frame; a pair of support arms; padded rollers; means rotatably securing a pair of said padded rollers to the outer end of each of said support arms to engage both sides of the portion of a leg above the knee of a user; means to selectively adjust the distance between the axes of rotation of each pair of said padded rollers on the outer end of each said arm; means pivotally securing each one of said support arms to each side of said support frame so as to permit individual pivoting by each said arm, the legs of the user being positioned between the support arms and the axis of rotation of each of said support arms being substantially aligned with the axis of rotation of the ball and socket joined between the leg and the hip of the user; and actuated means pivotally secured between the support frame and each of the support arms to control the rate of movement of each said support arm independently of each said support arm such that said support arms may be moved by a user from a first position wherein the upper leg of the user is substantially parallel with the plane formed by the back of the user to a position wherein the upper leg is substantially perpendicular to the back of the user.

2. A hip and leg exercising device according to claim 1 wherein the actuated means comprises: a pair of hollow cylinders having fluid disposed therein; means pivotally securing a first end of each said hollow cylinder to each side of said support frame; a pair of piston rods; means securing each said piston rod to one of said support arms; a piston secured to the end of each said piston rod, each said piston being slidably disposed in one of said cylinders; and dampening means to resist movement of fluid in each said cylinder from one end of each said cylinder to the other end of each said cylinder on the opposite side of each said piston.

3. A hip and leg exercising device according to claim 2, said means to adjust the distance between the axes of rotation of each pair of padded rollers comprising: inner and outer tubular sleeves, said inner tubular sleeve being slidably disposed in said outer tubular sleeve; means rotatably securing one of said padded rollers to each of said inner and outer tubular sleeves; and means secured between said inner and outer tubular sleeves for adjusting the position of said inner tubular sleeve relative to said outer tubular sleeve to thereby adjust the distance between axes of the padded rollers.

4. In a device to exercise muscles in the groin, thigh and hip of a human leg which are used for running, the improvement comprising: body support means adapted to support a human body in a prone position; a pair of leg engaging members; means movably securing one of said leg engaging members to each side of said body support means to engage an upwardly extending human leg when a human body is in the prone position on said body support means; a pair of hollow cylinders having fluid disposed therein; means pivotally securing a first end of each said hollow cylinder to each side of said body support means; a pair of piston rods; means securing each said piston rod to one of said leg engaging members; a piston secured to the end of each said piston rod, each said piston being slidably disposed in one of said cylinders; and means to resist movement of fluid from one end of each said cylinder to the other end of each said cylinder on the opposite side of each said piston to resist movement of a leg throughout an entire range of running movement upon movement of the leg in each direction.

5. In a device to exercise muscles in the groin, thigh and hip of a human leg according to claim 4 each of said leg engaging members comprising: a support arm; a pair of spaced leg gripping means secured to the outer end of each said support arm; and an extension member on each said support arm connectable to one of said piston rods.

* * * * *